US007325323B2

(12) United States Patent
Katsu et al.

(10) Patent No.: US 7,325,323 B2
(45) Date of Patent: Feb. 5, 2008

(54) FOOT TILT ANGLE MEASURING METHOD, METHOD OF SELECTING SHOE OR INSOLE FOR SHOE METHOD OF MANUFACTURING SHOE OR INSOLE FOR SHOE, AND FOOT UNIT TILT ANGLE MEASURING DEVICE

(75) Inventors: Makoto Katsu, Kobe (JP); Hironori Shinohara, Kobe (JP); Hiroyuki Kusumi, Kobe (JP)

(73) Assignee: ASKS Corp., Kobe (JP)

( * ) Notice: Subject to any disclaimer, the term of this patent is extended or adjusted under 35 U.S.C. 154(b) by 0 days.

(21) Appl. No.: 10/550,772

(22) PCT Filed: Apr. 1, 2004

(86) PCT No.: PCT/JP2004/004790

§ 371 (c)(1),
(2), (4) Date: Feb. 8, 2006

(87) PCT Pub. No.: WO2004/089145

PCT Pub. Date: Oct. 21, 2004

(65) Prior Publication Data

US 2006/0201011 A1 Sep. 14, 2006

(30) Foreign Application Priority Data

Apr. 4, 2003 (JP) ..... 2003-101708

(51) Int. Cl.
*A61B 5/107* (2006.01)

(52) U.S. Cl. ..... 33/512; 33/515

(58) Field of Classification Search ..... 33/512, 33/3 R, 3 A, 3 B, 3 C, 1 V, 511, 515, 514.2
See application file for complete search history.

(56) References Cited

U.S. PATENT DOCUMENTS

| | | | | |
|---|---|---|---|---|
| 2,472,754 | A * | 6/1949 | Mead | 33/515 |
| 3,457,647 | A * | 7/1969 | Cohen et al. | 33/3 R |
| 3,990,159 | A * | 11/1976 | Borgeas | 36/101 |

(Continued)

FOREIGN PATENT DOCUMENTS

| | | |
|---|---|---|
| JP | 2000-090272 | 3/2000 |
| JP | 2000-182080 | 6/2000 |
| JP | 2001-104005 | 4/2001 |
| JP | 2001-184373 | 7/2001 |
| JP | 2002-172104 | 6/2002 |

OTHER PUBLICATIONS

Kouchi et al. "Relation between the medial axis of the foot outline and 3-D foot shape" Ergonomics, vol. 39, No. 6, 853-861, 1996.*

(Continued)

*Primary Examiner*—Christopher W Fulton
(74) *Attorney, Agent, or Firm*—Michael E. Zal

(57) ABSTRACT

In a foot inclination angle measuring method of the present application, the shape of a foot 10 is measured in three dimensions. And, based on three-dimensional data on the measured shape of the foot 10, a two-dimensional cross section 30 of the foot 10 orienting in a front-rear direction, which includes a cross section of a heel of the foot 10, is obtained. Then, a central line C1 of the two-dimensional cross section 30 in a right-left direction is obtained and the angle of inward/outward inclination of the foot 10 is obtained from the angle of inclination (a) of the central line C1.

12 Claims, 6 Drawing Sheets

U.S. PATENT DOCUMENTS

| | | | | |
|---|---|---|---|---|
| 4,784,143 | A * | 11/1988 | Hebert et al. | 36/144 |
| 4,917,105 | A * | 4/1990 | Tiitola et al. | 33/515 |
| 5,231,723 | A * | 8/1993 | White et al. | 33/3 R |
| 5,671,055 | A * | 9/1997 | Whittlesey et al. | 33/3 R |
| 5,800,364 | A * | 9/1998 | Glennie et al. | 600/592 |
| 6,331,893 | B1 * | 12/2001 | Brown et al. | 33/3 R |
| 6,925,723 | B1 * | 8/2005 | Hartford | 33/3 R |
| 7,051,452 | B2 * | 5/2006 | Brooks | 33/515 |
| 7,086,168 | B2 * | 8/2006 | Spivey | 33/515 |
| 2004/0193075 | A1 * | 9/2004 | Martindale | 33/515 |

OTHER PUBLICATIONS

Camacho et al. "A three-dimensional, anotomically detailed foot model: A foundation for a finite element simulation and means of quantifying foot-bone position" Journal of Rehabilitaion Research and Development vol. 39 No. 3 401-410, May/June 2002.*

* cited by examiner (a)

(b)

(c)

(a)

(b)

FOOT TILT ANGLE MEASURING METHOD, METHOD OF SELECTING SHOE OR INSOLE FOR SHOE METHOD OF MANUFACTURING SHOE OR INSOLE FOR SHOE, AND FOOT UNIT TILT ANGLE MEASURING DEVICE

TECHNICAL FIELD

The present invention relates to a method of measuring the angle of inclination of a human foot, a method of selecting (manufacturing), based on the angle of inclination of a human foot measured by the foot inclination angle measuring method, a shoe or shoe sock liner, and a system of measuring the angle of inclination of a human foot.

BACKGROUND ART

In order to select or manufacture a shoe or a shoe sock liner which properly fits a foot of a customer, the angle of inward/outward inclination of the customer's foot is measured. The foot inclination angle is one of the most critical information in selecting (manufacturing) a shoe (especially, such as a custom-made shoe and a corrective shoe) or a shoe sock liner (especially, such as a corrective sock liner and a sock liner part). To sum up, based on the measured foot inclination angle and so on, a shoe or a shoe sock liner for correcting the inclination of a foot is selected or manufactured.

Conventionally, the angle of inclination of a human foot is measured by a specialist skillful at foot measurement (such as experts including orthopedist, physiotherapist, artificial-limb orthotist, shoe fitter etc.) while the foot is being examined by touch. More specifically, the upper and lower ends of a calcaneal bone when viewed from the rear of the foot are confirmed by palpation. Then, a line connecting together these two points is drawn on the skin and the angle of inclination of that line is measured (see, for example, JP 2001-104005 A (page 3, FIG. 2)).

However, the problem with the above is that measurement of the angle of inclination of a foot by palpation requires measurers with the right skills. It is difficult for an inexperienced measurer to make accurate measurement of the foot inclination angle and, besides, the level of reproducibility is low. This may arise a situation that measured inclination angles may differ with the measurer. For this reason, it has been difficult to select (manufacture) shoes (particularly, such as custom-made shoes and corrective shoes) or shoe sock liners (particularly, such as corrective sock liners and sock liner parts) which are best suited for customers.

DISCLOSURE OF INVENTION

With the above-described problem in mind, the present invention was made. Accordingly, an object of the present invention is to provide: a foot inclination angle measuring method capable of objectively measuring the angle of inclination of a human foot with reproducibility, without requiring skill; a method of selecting (manufacturing), based on the angle of inclination of a human foot measured by means of the foot inclination angle measuring method, a shoe (particularly, such as a custom-made shoe and a corrective shoe) or a shoe sock liner (particularly, such as a corrective sock liner and an sock liner part); and a measuring system capable of measuring the angle of inclination of a human foot.

As a solution to the above-mentioned problem, the present invention provides a foot inclination angle measuring method which comprises the steps of: measuring the shape of a human foot in three dimensions; based on three-dimensional data on the measured shape of the foot, obtaining a two-dimensional cross section of the foot orienting in a front-rear direction, which includes a cross section of a heel of the foot; obtaining a central line of the two-dimensional cross section in a right-left direction; and obtaining the angle of inward/outward inclination of the foot from the angle of inclination of the central line.

In accordance with the foot inclination angle measuring method of the present invention, it is arranged that the angle of inclination of a foot is obtained from a cross section of the foot which is obtained based on three-dimensional data on the shape of the foot. Such arrangement makes it possible to objectively obtain the angle of inclination of a foot. In addition, the angle of inclination of a foot is obtained with high reproducibility, without requiring skill.

Furthermore, as another solution to the above-mentioned problem, the present invention provides a shoe or shoe sock liner selecting method which comprises the steps of: measuring the shape of a human foot in three dimensions; based on three-dimensional data on the measured shape of the foot, obtaining a two-dimensional cross section of the foot orienting in a front-rear direction, which includes a cross section of a heel of the foot; obtaining a central line of the two-dimensional cross section in a right-left direction; obtaining the angle of inward/outward inclination of the foot from the angle of inclination of the central line; and based on the obtained foot inward/outward inclination angle, selecting a fitting shoe or shoe sock liner for correcting the inward/outward inclination of the foot from among multiple types of previously prepared shoes or shoe sock liners.

In accordance with the shoe or shoe sock liner selecting method of the present invention, it is arranged that the angle of inclination of a foot is derived from a cross section of the foot which is obtained based on three-dimensional data on the shape of the foot. Such arrangement makes it possible to objectively obtain the angle of inclination of a foot with high reproducibility. And, a shoe or a shoe sock liner is chosen based on the obtained foot inclination angle etc. Therefore, it becomes possible to objectively select a shoe or shoe sock liner suitable for correcting the inward/outward inclination of a foot, without requiring skill.

The term "shoe sock liner" used here includes a corrective shoe sock liner. In addition, the term "shoe sock liner" used here further includes not only an ordinary shoe sock liner which is in contact with the entire foot sole but also a shoe sock liner (a so-called sock liner part) which is in contact with a specific part of the foot sole. In addition, the "sock liner part" is a part which is attached to an ordinary shoe sock liner for locally increasing the thickness of the shoe sock liner.

The shoe or shoe sock liner selecting method may comprise the steps of: obtaining the rate of arch height of the foot from the three-dimensional data on the measured shape of the foot; and, based on the obtained foot inward/outward inclination angle and the obtained foot arch height rate, selecting a fitting shoe or shoe sock liner for correcting the inward/outward inclination of the foot and for correcting the flatness of the foot.

The shoe or shoe sock liner selecting method may comprise the steps of: obtaining the angle of inward inclination of a first toe of the foot from the three-dimensional data on the measured shape of the foot; and, based on the obtained foot inward/outward inclination angle and the obtained first-toe inward inclination angle, selecting a fitting shoe or shoe sock liner for correcting the inward/outward inclination of the foot and for correcting hallux valgus of the foot.

As a solution to the above-mentioned problem, the present invention provides a shoe or shoe sock liner manufacturing method which comprises the steps of: measuring the shape of a human foot in three dimensions; based on three-dimensional data on the measured shape of the foot, obtaining a two-dimensional cross section of the foot orienting in a front-rear direction, which includes a cross section of a heel of the foot; obtaining a central line of the two-dimensional cross section in a right-left direction; obtaining the angle of inward/outward inclination of the foot from the angle of inclination of the central line; obtaining the shape of a sole of the foot from the three-dimensional data on the measured shape of the foot; and, based on the obtained foot inward/outward inclination angle and the obtained foot sole shape, manufacturing a fitting shoe or shoe sock liner for correcting the inward/outward inclination of the foot.

In accordance with the shoe or shoe sock liner manufacturing method of the present invention, it is arranged that the angle of inclination of a foot is derived from a cross section of the foot which is obtained based on three-dimensional data on the shape of the foot. Such arrangement makes it possible to objectively obtain the angle of inclination of a foot with high reproducibility. And, a shoe (particularly, such as a custom-made shoe and a corrective shoe) or a shoe sock liner (particularly, such as a corrective sock liner and an sock liner part) is manufactured based on the obtained foot inclination angle etc. Therefore, it becomes possible to manufacture a shoe or shoe sock liner suitable for correcting the inward/outward inclination of a foot, without requiring skill.

The shoe or shoe sock liner manufacturing method may comprise the steps of: obtaining the rate of arch height of the foot from the three-dimensional data on the measured shape of the foot; and, based on the obtained foot inward/outward inclination angle, the obtained foot sole shape, and the obtained foot arch height rate, manufacturing a fitting shoe or shoe sock liner for correcting the inward/outward inclination of the foot and for correcting the flatness of the foot.

The shoe or shoe sock liner manufacturing method may comprise the steps of: obtaining the angle of inward inclination of a first toe of the foot from the three-dimensional data on the measured shape of the foot; and, based on the obtained foot inward/outward inclination angle, the obtained foot sole shape, and the obtained first-toe inward inclination angle, manufacturing a fitting shoe or shoe sock liner for correcting the inward/outward inclination of the foot and for correcting hallux valgus of the foot.

As another solution to the above-mentioned problem, the present invention provides a foot inclination angle measuring system which comprises: a three-dimensional measuring means for measuring the shape of a human foot in three dimensions; a cross section recognizing means for recognizing, based on three-dimensional data on the measured shape of the foot by the three-dimensional measuring means, a two-dimensional cross section of the foot orienting in a front-rear direction, which includes a cross section of a heel of the foot; and an inclination angle calculating means for calculating the angle of inclination of a central line of the two-dimensional cross section of the foot in a right-left direction recognized by the cross section recognizing means.

In accordance with the foot inclination angle measuring system of the present invention, it is arranged that the angle of inclination of a foot is obtained from a cross section of the foot which is obtained based on three-dimensional data on the shape of the foot. Such arrangement makes it possible to objectively obtain the angle of inclination of a foot. In addition, the angle of inclination of a foot is obtained with high reproducibility, without requiring skill.

These objects as well as other objects, features and advantages of the present invention will become apparent from the detailed description of the following preferred embodiments with reference to the accompanying drawings.

BRIEF DESCRIPTION OF DRAWINGS

FIG. 2 is a schematic block diagram of a measuring system for measuring the shape of a foot sole and so on;

BEST MODE FOR CARRYING OUT INVENTION

An embodiment of the present invention will be described with reference to the drawings.

In the present embodiment, the shape of a foot sole of a customer, the angle of inward/outward inclination of the foot, the rate of arch height of the foot, the angle of inward inclination to a first toe of the foot and so on are measured by a measuring system including a three-dimensional measuring instrument. And, based on these measured values etc., a shoe sock liner (especially, such as a corrective sock liner and an sock liner part) that properly fits the customer's foot is selected.

Figure 1:
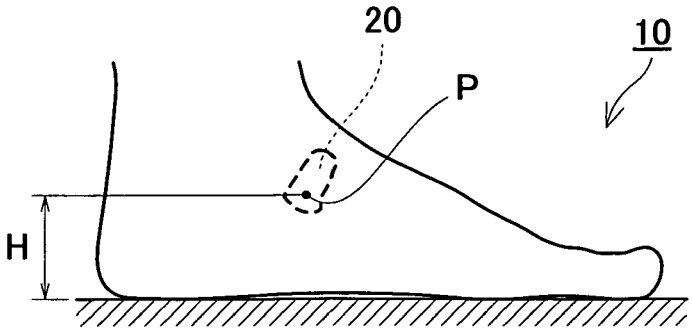
FIG. 1 is a view of a human foot wherein FIG. 1(*a*) is a side view, FIG. 1(*b*) is a top plan view, and FIG. 1(*c*) is a rear view.
Figure 1:
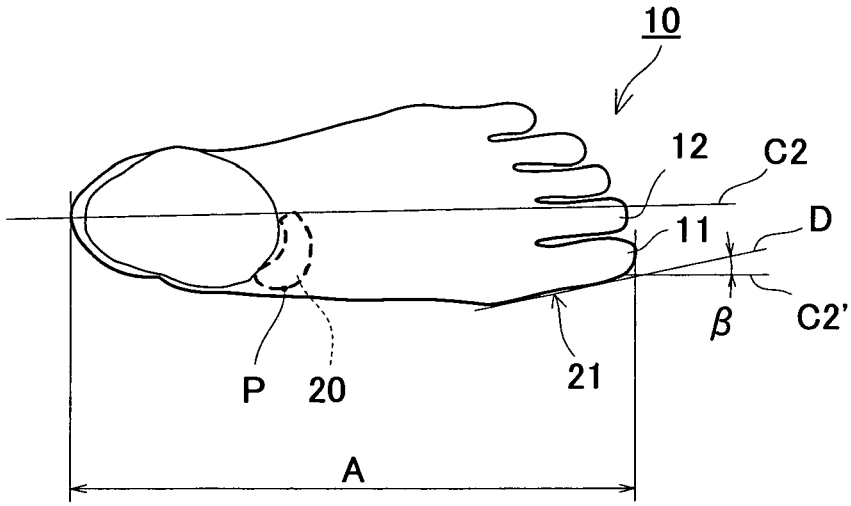
Figure 1:
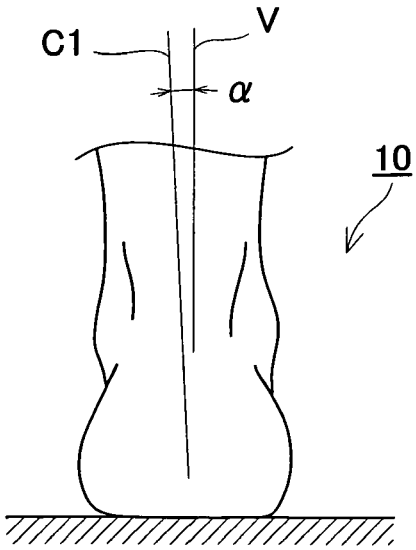

FIG. 1 is an illustration of a foot 10 (left foot). FIG. 1(*a*) is a side view of the foot 10. FIG. 1(*b*) is a top plan view of the foot 10. FIG. 1(*c*) is a rear view of the foot 10. With reference to FIG. 1, the angle of inward/outward inclination of a foot, the foot arch height rate, and the angle of inward inclination of a foot's first toe are described.

The angle of foot inward/outward inclination is an angle a at which a central line C1 of the foot 10 when viewed from the rear (or the front) leans in an inside/outside direction relative to a vertical line V (see FIG. 1(*c*)). If the inclination angle a falls within a standard-value range, this requires no correction. On the other hand, if the inclination angle a goes beyond the standard-value range, this requires correction.

The foot arch height rate is a value derived from dividing the height (H) of a part P which is a most outwardly bulged portion of a navicular bone 20 by the length (A) of the foot 10 (see FIGS. 1(*a*) and 1(*b*)). If the arch height rate (H/A) falls within a standard-value range, this requires no correction. If the arch height rate (H/A) falls below the standard-value range, the foot 10 is decided as a flat foot, and correction is required. On the other hand, if the arch height rate (H/A) goes beyond the standard-value range, the foot 10 is decided as a high arch, and correction is required.

The angle of first-toe inward inclination is an angle β at which a side surface 21 of a first toe 11 situated opposite to a second toe 12 leans inside relative to a central line C2 of the foot 10 in plan view (or in bottom view) (see FIG. 1(*b*)). With reference to FIG. 1(*b*), a line D is a tangent line of the side surface 21 while, on the other hand, a line C2' is a line in parallel with the central line C2. If the inclination angle β falls within a standard-value range, this requires no correction. On the other hand, if the inclination angle β goes beyond the standard-value range, it is decided that the foot 10 suffers hallux valgus, and correction is required.

Figure 2:
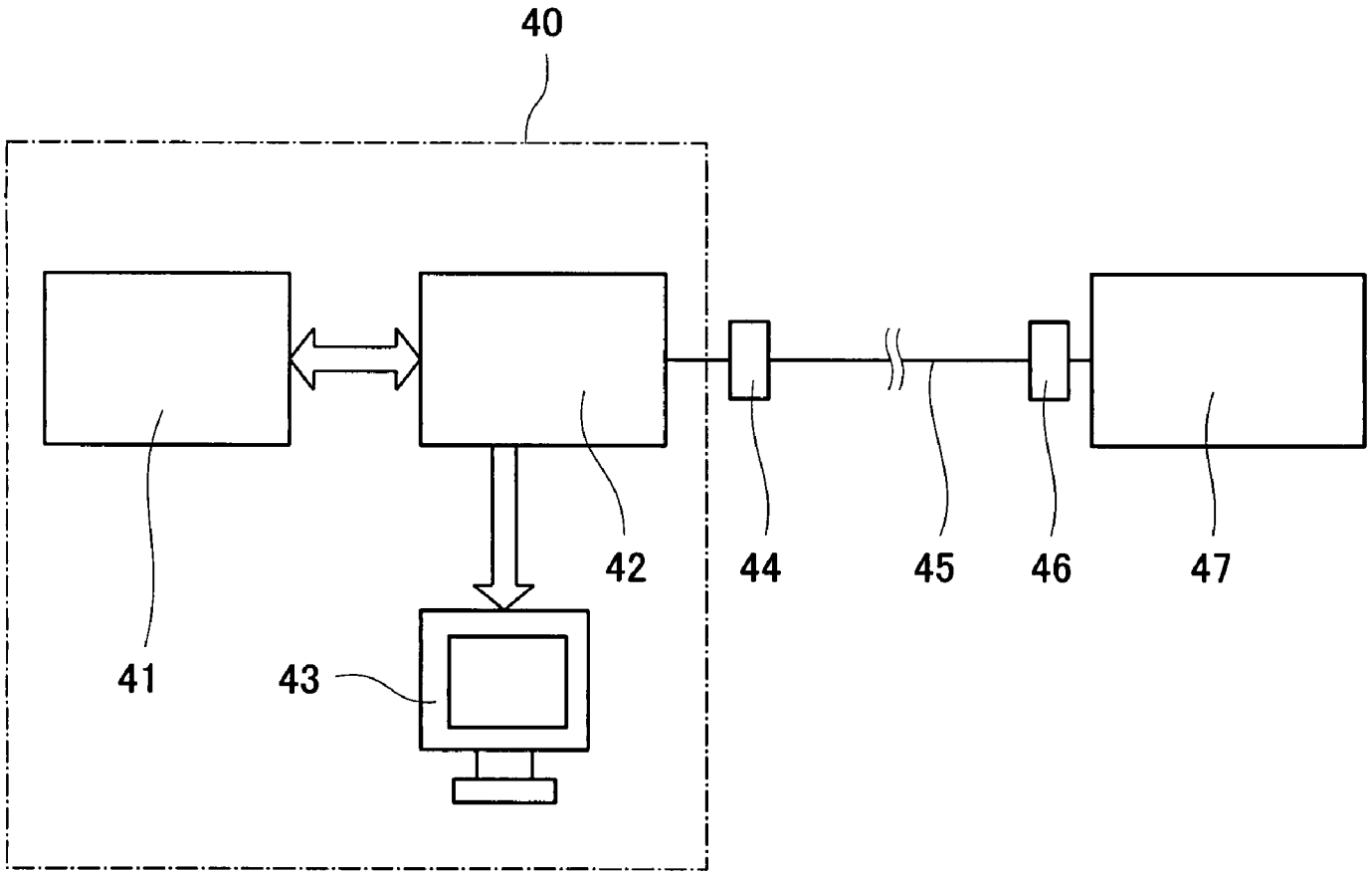

With reference to FIG. 2, there is shown a schematic block diagram of a measuring system 40 for measuring the shape of a foot sole etc. The measuring system 40 is provided with a three-dimensional measuring instrument 41, a personal computer main unit 42, and a display unit 43. The measuring instrument 40 is generally installed in a shoe retail shop.

The three-dimensional measuring instrument 41 is a device for obtaining three-dimensional data on the shape of the foot 10 by detecting three-dimensional coordinate positions at multiple points on the surface of the customer's foot 10. When the customer places his/her foot 10 on the three-dimensional measuring instrument 41, three-dimensional data about the shape of the foot 10 are obtained automatically. Based on the three-dimensional data thus obtained, the personal computer main unit 42 recognizes/calculates the shape of a sole of the foot 10, the angle of inward/outward inclination of the foot 10, the arch height rate of the foot 10, the angle of inward inclination of the first toe 11 of the foot 10 etc.

The sole shape of the foot 10, the inward/outward inclination angle of the foot 10, the arch height rate of the foot 10, the inward inclination angle of the first toe 11 of the foot 10 which are recognized and calculated by the personal computer main unit 42 are transmitted to a base station 47 through a communication line 45. At the base station 47, a shoe sock liner (especially, such as a corrective sock liner and an sock liner part) that properly fits the customer's foot 10 is selected based on the data transmitted from the personal computer main unit 42. Reference numerals 44, 46 represent communication interfaces.

In the first place, the personal computer main unit 42 is fed three-dimensional data on the shape of the foot 10 obtained by the three-dimensional measuring instrument 41. This data includes data on the sole shape of the foot 10. Therefore, the personal computer main unit 42 is able to recognize the sole shape of the foot 10 from the three-dimensional data on the shape of the foot 10 taken from the three-dimensional measuring instrument 41. The recognized sole shape of the foot 10 is displayed on the display unit 43.

Next, the personal computer main unit 42 recognizes a cross section of the foot 10 orienting in a front-rear direction (orthogonal to the central line C2) from the three-dimensional data on the shape of the foot 10 transferred from the three-dimensional measuring instrument 41, which includes a cross section of a heel of the foot 10.

Figure 3:
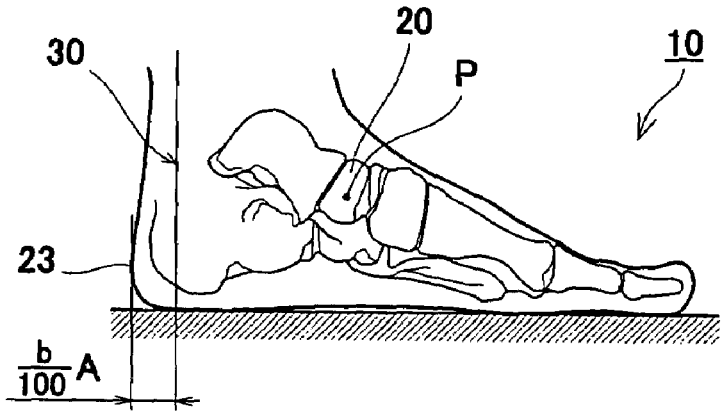
FIG. 3 is an illustration of a human foot measured by a three-dimensional measuring instrument wherein FIG. 3(*a*) is a side view and FIG. 3(*b*) is a top plan view.
Figure 3:
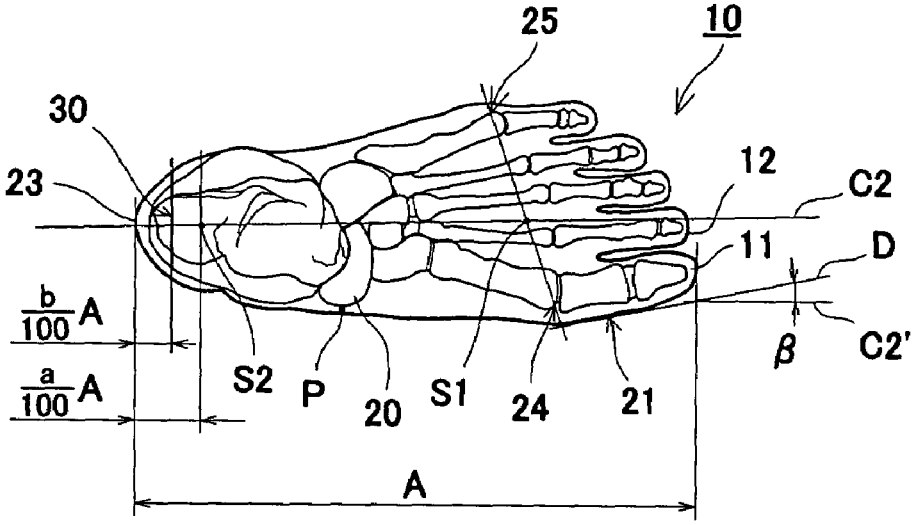
Figure 4:
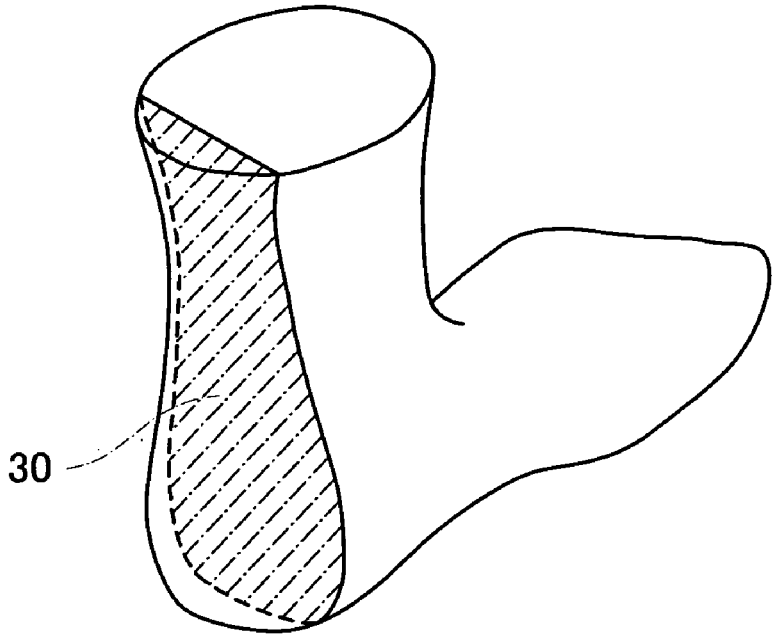
FIG. 4 is a perspective view of a human foot.

With reference to FIGS. 3 and 4, the relationship between the shape of the foot 10 measured by the three-dimensional measuring instrument 41 and the cross section 30 of the foot 10 recognized by the personal computer main unit 42 is discussed.

FIG. 3 is an illustration of the foot 10 measured by the three-dimensional measuring instrument 41. FIG. 3(*a*) is a side view of the foot 10. FIG. 3(*b*) is a top plan view of the foot 10. In the figure, bones are also shown in a "see-through" manner, but the three-dimensional measuring instrument 41 is not designed to measure the shape and position of bones. The three-dimensional measuring instrument 41 is configured to measure the surface profile of the foot 10. For the purpose of providing an easy understanding, the bones are shown transparently in FIG. 3.

In the first place, the personal computer main unit 42 recognizes the surface profile of the foot 10 from three-dimensional data on the foot 10 obtained by the three-dimensional measuring instrument 41. And, from the recognized surface profile of the foot 10, the position of a fifth metatarsal head 25 and the position of a first metatarsal head 24 are recognized. Then, a bisecting point S1 of a straight line connecting together the points (the points 25 and 24) is recognized. Next, a central point S2 in a right-left direction at a position located ahead of a rearmost end 23 of the foot 10 by a distance of a % of the foot length A (here, preferably the value of "a" exceeds 0 but is not more than 20 and, more preferably, the value of "a" is not less than 4 nor more than 16) is recognized. And, a straight line connecting together the point S1 and the point S2 is taken as the central line (foot axial line) C2 in plan view of the foot 10. Next, at a position located ahead of the rearmost end 23 of the foot 10 by a distance of b % of the foot length A, a cross section orthogonal to the central line C2 is extracted (here, preferably the value of "b" exceeds 0 but is not more than 15 and, more preferably, the value of "b" is not less than 4 nor more than 11). This extracted cross section is recognized as the cross section 30 of the foot 10 (orthogonal to the central line C2) orienting in a front-rear direction, and includes a cross section of a heel of the foot 10. In FIG. 4, the cross section 30 thus recognized is shown in a superimposed relation with a perspective view of the foot 10.

Figure 5:
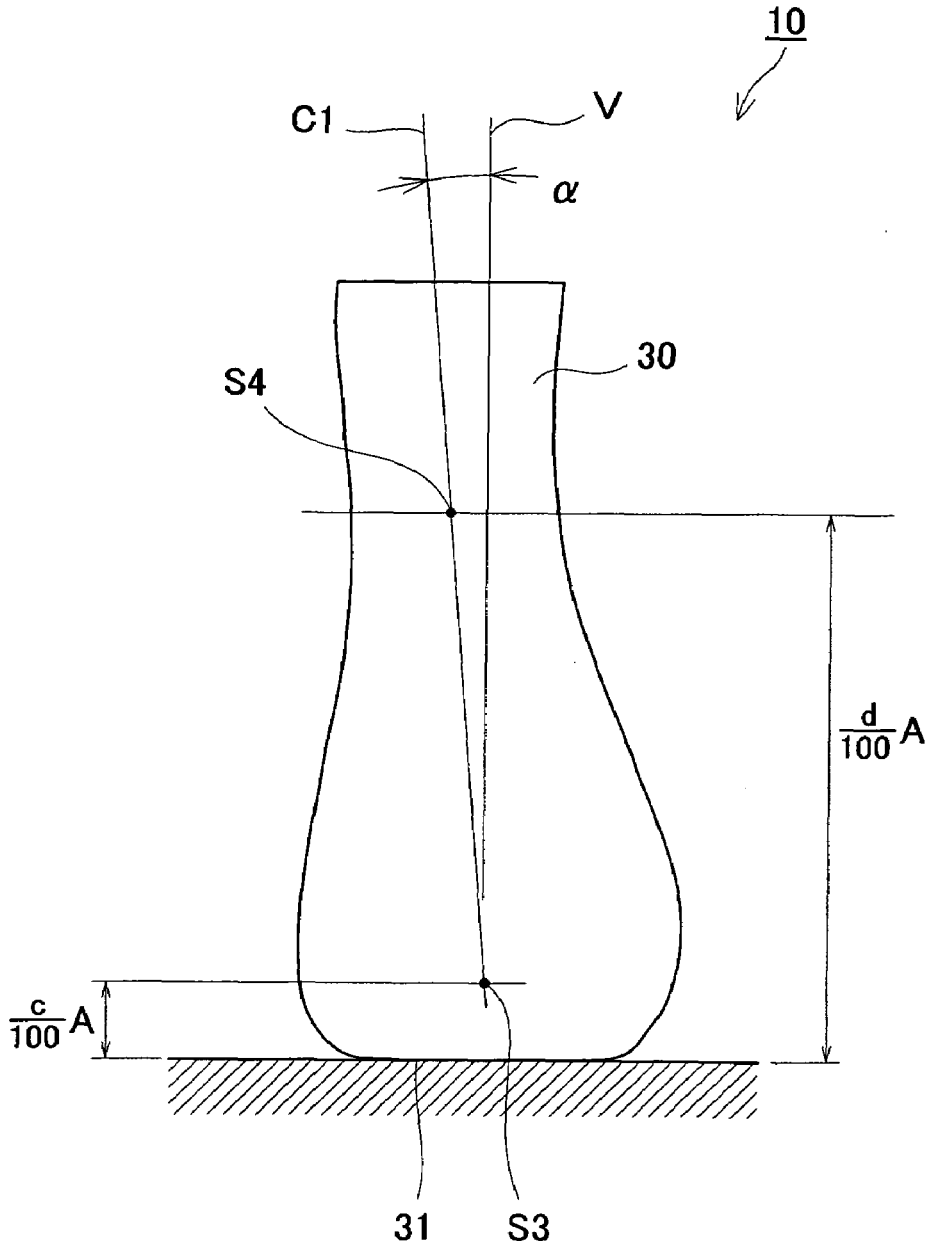
FIG. 5 is a cross sectional view of a human foot.

Next, the personal computer main unit 42 calculates the inclination angle a of the central line C1 in a right-left direction of the cross section 30. Referring to FIG. 5, there is illustrated the cross section 30. In order to calculate the inclination angle a, a point S3 corresponding to the central line (foot axial line) C2 in plan view of the foot 10 at a position at a height of c % of the foot length A from a bottommost position (foot-sole position) 31 is recognized (here, preferably the value of "c" is not less than 0 nor more than 10 and, more preferably, the value of "d" is not less than 2 nor more than 6). In addition, a central point S4 in a right-left direction of the cross section 30 at a position at a height of d % of the foot length A from the bottommost position (foot-sole position) 31 is recognized (here, preferably the value of "d" is not less than 10 nor more than 40 and, more preferably, the value of "d" is not less than 20 nor more than 30). And, a straight line connecting together the point S3 and the point S4 is recognized as the central line C1 of the foot 10 when viewed from the rear (or the front). And, the inclination angle a of the central line C1 relative to the vertical line V is calculated. The inclination angle a thus calculated serves as the angle of foot inward/outward inclination.

As described above, the personal computer main unit 42 has a cross section recognizing function of recognizing, based on three-dimensional data on the shape of the foot 10 obtained by the three-dimensional measuring instrument 41, the heel-including cross section 30 of the foot 10 orienting in a front-rear direction, and an inclination angle calculating function of calculating the inclination angle a of the central line C1 in a right-left direction of the cross section 30 of the foot 10 recognized by the cross section recognizing function.

In addition, it is not necessarily required to recognize the cross section based on the points S1, S2. The point is that it suffices if a cross section orienting in a front-rear direction and including a heel cross section is recognized based on three-dimensional data on the shape of the foot 10. Furthermore, it is not necessarily required to recognize the central line C1 based on the points S3, S4. The point is that it suffices if a central line in a right-left direction of the cross section 30 is recognized by some means.

The display unit 43 displays a cross section as shown in FIG. 5 and an inclination angle a for the provision of visual information to the customer.

Next, the personal computer main unit 42 calculates, from the three-dimensional data on the shape of the foot 10 taken from the three-dimensional measuring instrument 41, the rate of arch height of the foot 10. As described above, the arch height rate is a value derived from dividing the height (H) of the part P which is a most outwardly bulged part of the navicular bone 20 by the foot length A. From the three-dimensional data on the shape of the foot 10, the position of the part P which is a most outwardly bulged part of the navicular bone 20 and so on are recognized, which makes it possible to calculate the arch height rate of the foot 10. In addition, in order to more accurately recognize the position of the part P which is a most outwardly bulged part of the navicular bone 20, it is advisable to put a mark on the part P which is a most outwardly bulged part of the navicular bone 20 prior to the placement of the foot 10 on the three-dimensional measuring instrument 41. Such a mark facilitates recognition of the position of the part P by the three-dimensional measuring instrument 41. The calculated arch height rate is displayed on the display unit 43.

Next, from the three-dimensional data on the shape of the foot 10 taken from the three-dimensional measuring instrument 41, the personal computer main unit 42 calculates the angle of inward inclination (β) of the first toe 11. Stated another way, the side surface 21 of the first toe 11 is recognized from the three-dimensional data on the shape of the foot 10, thereby to calculate the inward inclination angle β of the first toe 11. The calculated inward inclination angle β of the first toe 11 is displayed on the display unit 43.

In the way as described above, the foot sole shape, the inward/outward inclination angle a of the foot 10, the foot arch height rate, and the inward inclination angle β of the first toe 11 which are recognized or calculated by the personal computer main unit 42 are transmitted, through the communication line 45 (see FIG. 2), to the base station 47. At the base station 47, based on these transmitted data (i.e., the foot sole shape, the inward/outward inclination angle a of the foot 10, the foot arch height rate, and the inward inclination angle β of the first toe 11), a shoe sock liner (especially, such as a corrective sock liner and an sock liner part) that properly fits the foot 10 is selected from among multiple types of previously prepared shoe sock liners (especially, such as corrective sock liners and sock liner parts). These prepared shoe sock liners (especially, such as corrective sock liners and sock liner parts) vary in shape. The prepared shoe sock liners include various types, such as a type of shoe sock liner each portion of which has a standard thickness and a type of shoe sock liner having a specific portion whose thickness is greater or less than the standard thickness. In addition, the prepared shoe sock liners include other types, such as a type of shoe sock liner each portion of which has a standard hardness and a type of shoe sock liner having a specific portion whose hardness is greater than the standard hardness. At the base station 47, it is possible to choose, based only on a foot sole shape recognized by the personal computer main unit 42, a shoe sock liner (especially, such as a corrective sock liner and an sock liner part) having a shape that best fits to the computer-recognized foot sole shape, but a shoe sock liner (especially, such as a corrective sock liner and an sock liner part) capable of correcting the foot 10 is selected here.

Figure 6:
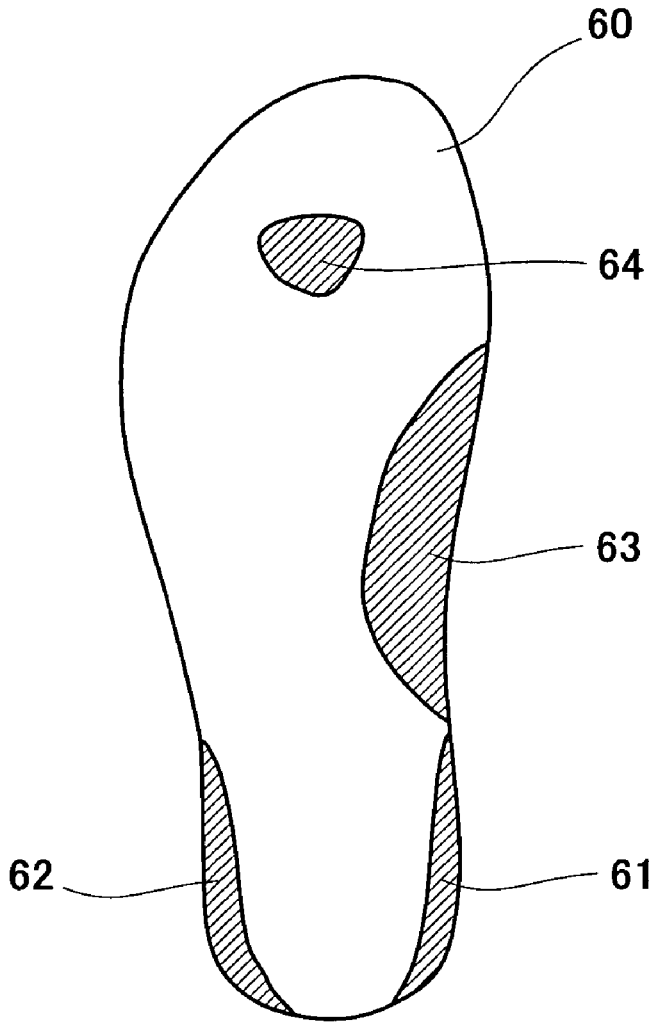
FIG. 6 is a top plan view of a shoe sock liner.

With reference to FIG. 6, there is shown a top plan view of a shoe sock liner 60. The shoe sock liner 60 is not a so-called "sock liner part" but is a shoe sock liner of the type which comes into contact with the entire foot sole. With reference to FIG. 6, a specific example of a method of selecting a shoe sock liner is described while showing each part of the shoe sock liner 60.

For example, if the angle of inward inclination of the foot is above the standard, this selects either a shoe sock liner having a heel inside portion 61 of a greater thickness relative to the shape best fitted to the foot sole shape or a shoe sock liner whose heel inside portion 61 has a greater hardness than the standard hardness. In addition, if the angle of outward inclination of the foot is above the standard, this selects either a shoe sock liner having a heel outside portion 62 of a greater thickness relative to the shape best fitted to the foot sole shape or a shoe sock liner whose heel outside portion 62 has a greater hardness than the standard hardness. Consequently, it becomes possible to select a shoe sock liner capable of correcting the inward/outward inclination of the foot.

Furthermore, if the foot arch height rate is smaller than the standard foot arch height rate, this selects either a shoe sock liner having a plantar arch portion 63 of a greater thickness relative to the shape best fitted to the foot sole shape or a shoe sock liner whose plantar arch portion 63 has a greater hardness than the standard hardness. Consequently, it becomes possible to select a shoe sock liner capable of correcting the flatness of the foot.

In addition, if the first-toe inward inclination angle is greater than the standard first-toe inward inclination angle, this selects either a shoe sock liner having a root portion 64 of the second and third toes which has a greater thickness relative to the shape best fitted to the foot sole shape or a shoe sock liner whose root portion 64 has a greater hardness than the standard hardness. Consequently, it becomes possible to select a shoe sock liner capable of correction of hallux valgus.

For example, if measurement of a foot of a customer by the measuring system 40 shows that the angle of inward/outward inclination of the foot is standard; the arch height rate of the foot is standard; and the angle of inward inclination of the first toe is standard, then there is no need to correct the customer's foot. Accordingly, it suffices if a shoe sock liner having a shape best fitted to the foot sole shape of the customer is selected.

In addition, for example, if measurement of a foot of another customer by the measuring system 40 shows that the angle of inward/outward inclination of the foot is greater than the standard inclination angle; the arch height rate of the foot is smaller than the standard arch height rate; and the angle of inward inclination of the first toe is greater than the standard inclination angle, this selects a shoe sock liner having a heel inside portion, a plantar arch portion, and a root portion of the second and third toes, each of which having a respective greater thickness relative to the shape best fitted to the customer's foot sole shape. Consequently, it becomes possible to select a shoe sock liner capable of correcting the inward inclination of the fool, correcting the flatness of the foot, and correcting hallux valgus of the foot.

In the way as described above, when at the base station 47 of FIG. 2 a shoe sock liner (especially, such as a corrective sock liner and an sock liner part) that properly fits the foot 10 is selected from among multiple types of previously prepared shoe sock liners (especially, such as corrective sock liners and sock liner parts), the selected shoe sock liner (especially, such as a corrective sock liner and an sock liner part) may be delivered to a shoe retail shop equipped with the measuring system 40 or may directly be sent to the customer. Alternatively, the selection of a shoe sock liner may be made at any shoe retail shop equipped with the measuring system 40, without establishing connection between the shoe retail shop and the base station through a communication line. In addition, the work of attachment of a selected sock liner part may be done at the retail shop.

One embodiment of the method has been described in which the shape of a foot sole of a customer, the angle of inward/outward inclination of the customer's foot, the arch height rate of the customer's foot, and the angle of inward inclination of the first toe are measured by a measuring system including a three-dimensional measuring instrument and, based on these measured values etc., a shoe sock liner (especially, such as a corrective sock liner and an sock liner part) that properly fits the customer's foot is chosen.

In the embodiment, the shape of a foot sole is adopted as the data for the selection of a shoe sock liner; however, such foot sole shape data is not necessarily required to be adopted as the data for the selection of a shoe or a shoe sock liner.

In addition, in the embodiment, based on the measured values (e.g., the shape of a foot sole of a customer, the angle of inward/outward inclination of the customer's foot, the arch height rate of the customer's foot, and the angle of inward inclination of the first toe), a shoe sock liner (especially, such as a corrective sock liner and an sock liner part) that properly fits the customer's foot is selected from among multiple types of previously prepared shoe sock liners. Alternatively, it may be arranged that instead of selecting a shoe sock liner, a shoe (especially, such as a custom-made shoe and a corrective shoe) is selected. In other words, based on the measured values (e.g., the angle of inward/outward inclination of a customer's foot, the arch height rate of the customer's foot, and the angle of inward inclination of the first toe), a shoe that properly fits the foot 10 is selected from among multiple types of previously prepared shoes. These prepared shoes vary in bottom surface shape (shoe inside bottom surface shape). The prepared shoes include various types, such as a type of shoe each portion of which has a standard thickness and a type of shoe having a specific portion whose thickness is greater or less than the standard thickness. In addition, the prepared shoes include other types, such as a type of shoe each portion of which has a standard hardness and a type of shoe having a specific portion whose hardness is greater than the standard hardness. It may be arranged that a shoe having a bottom surface shape capable of correction of the angle of inward/outward inclination of a customer's foot, flat foot, or hallux valgus is selected by the same method as employed to select a shoe sock liner in the above-described embodiment.

In addition, in the embodiment, based on the measured values (e.g., the shape of a foot sole of a customer, the angle of inward/outward inclination of the customer's foot, the arch height rate of the customer's foot, and the angle of inward inclination of the first toe), a shoe sock liner that properly fits the customer's foot is selected from among multiple types of previously prepared shoe sock liners. Alternatively, instead of selecting a shoe sock liner that properly fits the customer's foot from among multiple types of previously prepared shoe sock liner, a shoe sock liner (especially, such as a corrective sock liner and an sock liner part) that properly fits the customer's foot may be manufactured. In other words, a shoe sock liner (especially, such as a corrective sock liner and an sock liner part) capable of correction of the angie of inward/outward inclination of a customer's foot, flat foot, or hallux valgus is manufactured based on the measured values (such as the shape of a foot sole of a customer, the angle of inward/outward inclination of the customer's foot, the arch height rate of the customer's foot, and the angle of inward inclination of the first toe). It may be arranged that for the purpose of making it possible to correct a foot of a customer, a shoe sock liner is manufactured, such that a specific portion thereof has a greater or smaller thickness relative to the shape that best fits the shape of a foot sole of the customer. Alternatively, a shoe sock liner may be manufactured, such that a specific portion thereof has a greater hardness than the standard hardness.

In addition, in the embodiment, based on the measured values (e.g., the shape of a foot sole of a customer, the angle of inward/outward inclination of the customer's foot, the arch height rate of the customer's foot, and the angle of inward inclination of the first toe), a shoe sock liner that properly fits the customer's foot is selected from among multiple types of previously prepared shoe sock liners. Alternatively, instead of selecting a shoe sock liner that properly fits the customer's foot from among multiple types of previously prepared shoe sock liner, a shoe (especially, such as a custom-made shoe and a corrective shoe) that properly fits the customer's foot may be manufactured. In other words, a shoe capable of correction of the angle of inward/outward inclination of a customer's foot, flat foot, or hallux valgus is manufactured based on the measured values (such as the shape of a foot sole of a customer, the angle of inward/outward inclination of the customer's foot, the arch height rate of the customer's foot, and the angle of inward inclination of the first toe). It may be arranged that for the purpose of making it possible to correct a foot of a customer, a shoe is manufactured, such that a specific portion of the bottom surface thereof has a greater or smaller thickness relative to the shoe bottom surface shape that best fits the customer's foot sole shape. Alternatively, a shoe is manufactured, such that a specific portion thereof has a greater hardness than the standard hardness.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention.

INDUSTRIAL APPLICABILITY

The present invention provides a foot inclination angle measuring method, a shoe or shoe sock liner selecting method, a shoe or shoe sock liner manufacturing method, and a foot inclination angle measuring system, for the purpose of making it possible to objectively measure the angle of inclination of a foot of a customer with reproducibility, without requiring skill, and to select (manufacture) a shoe or a shoe sock liner which properly fits the customer's foot. Therefore, the present invention is beneficial to the technical field of shoes.

What is claimed is:

1. A foot inclination angle measuring method, comprising the steps of:

measuring a shape of a human foot in three dimensions;

based on three-dimensional data on the measured shape of the foot, obtaining a two-dimensional cross section of the foot orienting in a front-rear direction, which includes a cross section of a heel of the foot;

obtaining a central line which is a straight line connecting a point corresponding to a central line of the foot (foot axial line) at a height position of 2 to 6% of a foot length from a bottommost position in the two-dimensional cross-section to a central point of the two-dimensional cross-section in the right-left direction at a height position of 20 to 30% of the foot length from the bottommost position in the two-dimensional cross-section; and obtaining an angle of inward/outward inclination of the foot from an angle of inclination of the central line.

2. The foot inclination angle measuring method as set forth in claim 1, wherein the two-dimensional cross section is a two-dimensional cross section of the foot in a position ahead of a rearmost end of the foot by a distance of not less than 4% nor more than 11% of the length of the foot.

3. A shoe or shoe sock liner selecting method, comprising the steps of:

measuring a shape of a human foot in three dimensions;

based on three-dimensional data on the measured shape of the foot, obtaining a two-dimensional cross section of the foot orienting in a front-rear direction, which includes a cross section of a heel of the foot;

obtaining a central line which is a straight line connecting a point corresponding to a central line of the foot (foot axial line) at a height position of 2 to 6% of a foot length from a bottommost position in the two-dimensional cross-section to a central point of the two-dimensional cross-section in the right-left direction at a height position of 20 to 30% of the foot length from the bottommost position in the two-dimensional cross-section obtaining an angle of inward/outward inclination of the foot from an angle of inclination of the central line; and based on the obtained foot inward/outward inclination angle, selecting a fitting shoe or shoe sock liner for correcting an inward/outward inclination of the foot from among multiple types of previously prepared shoes or shoe sock liners.

4. The shoe or shoe sock liner selecting method as set forth in claim 3, comprising the steps of:

obtaining a rate of arch height of the foot from the three-dimensional data on the measured shape of the foot; and based on the obtained foot inward/outward inclination angle and the obtained foot arch height rate, selecting a fitting shoe or shoe sock liner for correcting the inward/outward inclination of the foot and for correcting the flatness of the foot.

5. The shoe or shoe sock liner selecting method as set forth in claim 3, comprising the steps of:

obtaining an angle of inward inclination of a side surface of a first toe of the foot with respect to the central line of the foot (foot axial line) from the three-dimensional data on the measured shape of the foot, the side surface of the first toe being on an opposite side of the a second toe of the foot; and based on the obtained foot inward/outward inclination angle and the obtained first-toe inward inclination angle, selecting a fitting shoe or shoe sock liner for correcting the inward/outward inclination of the foot and for correcting hallux valgus of the foot.

6. The shoe or shoe sock liner selecting method as set forth in claim 3, wherein the two-dimensional cross section is a two-dimensional cross section of the foot in a position ahead of a rearmost end of the foot by a distance of not less than 4% nor more than 11% of the length of the foot.

7. A shoe or shoe sock liner manufacturing method, comprising the steps of:

measuring a shape of a human foot in three dimensions;

based on three-dimensional data on the measured shape of the foot, obtaining a two-dimensional cross section of the foot orienting in a front-rear direction, which includes a cross section of a heel of the human foot;

obtaining a central line which is a straight line connecting a point corresponding to a central line of the foot (foot axial line) at a height position of 2 to 6% of a foot length from a bottommost position in the two-dimensional cross-section to a central point of the two-dimensional cross-section in the right-left direction at a height position of 20 to 30% of the foot length from the bottommost position in the two-dimensional cross-section;

obtaining an angle of inward/outward inclination of the foot from the angle of inclination of the central line;

obtaining a shape of a sole of the foot from the three-dimensional data on the measured shape of the foot; and based on the obtained foot inward/outward inclination angle and the obtained foot sole shape, manufacturing a fitting shoe or shoe sock liner for correcting an inward/outward inclination of the foot.

8. The shoe or shoe sock liner manufacturing method as set forth in claim 7, comprising the steps of:

obtaining a rate of arch height of the foot from the three-dimensional data on the measured shape of the foot; and based on the obtained foot inward/outward inclination angle, the obtained foot sole shape, and the obtained foot arch height rate, manufacturing a fitting shoe or shoe sock liner for correcting the inward/outward inclination of the foot and for correcting the flatness of the foot.

9. The shoe or shoe sock liner manufacturing method as set forth in claim 7, comprising the steps of:

obtaining an angle of inward inclination of a side surface of a first toe of the foot with respect to the central line of the foot (foot axial line) from the three-dimensional data on the measured shape of the foot, the side surface of the first toe being on an opposite side of the a second toe of the foot; and based on the obtained foot inward/outward inclination angle, the obtained foot sole shape, and the obtained first-toe inward inclination angle, manufacturing a fitting shoe or shoe sock liner for correcting the inward/outward inclination of the foot and for correcting hallux valgus of the foot.

10. The shoe or shoe sock liner manufacturing method as set forth in claim 7, wherein the two-dimensional cross section is a two-dimensional cross section of the foot in a position ahead of a rearmost end of the foot by a distance of not less than 4% nor more than 11% of the length of the foot.

11. A foot inclination angle measuring system comprising:

three-dimensional measuring means for measuring a shape of a human foot in three dimensions;

a cross section recognizing means for recognizing, based on three-dimensional data on the measured shape of the foot by the three-dimensional measuring means, a two-dimensional cross section of the foot orienting in a front-rear direction, which includes a cross section of a heel of the foot; and an inclination angle calculating means for calculating an angle of inclination of a central line of the two-dimensional cross section of the foot in a right-left direction recognized by the cross section recognizing means, wherein the central line is a straight line connecting a point corresponding to a central line of the foot (foot axial line) at a height position of 2 to 6% of a foot length from a bottommost position in the two-dimensional cross-section to a central point of the two-dimensional cross-section in the right-left direction at a height position of 20 to 30% of the foot length from the bottommost position in the two-dimensional cross-section.

12. The foot inclination angle measuring system as set forth in claim 11, wherein the two-dimensional cross section is a two-dimensional cross section of the foot in a position ahead of a rearmost end of the foot by a distance of not less than 4% nor more than 11% of the length of the foot.

* * * * *

UNITED STATES PATENT AND TRADEMARK OFFICE

CERTIFICATE OF CORRECTION

PATENT NO. : 7,325,323 B2
APPLICATION NO. : 10/550772
DATED : February 5, 2008
INVENTOR(S) : Makoto Katsu et al.

It is certified that error appears in the above-identified patent and that said Letters Patent is hereby corrected as shown below:

On the Title page, Item (73) Assignee: delete "ASKS" and insert -- ASICS --

Signed and Sealed this

Nineteenth Day of August, 2008

JON W. DUDAS
*Director of the United States Patent and Trademark Office*